United States Patent [19]

Spinnler

[11] 3,958,217

[45] May 18, 1976

[54] PILOT OPERATED MUD-PULSE VALVE

[75] Inventor: Ralph F. Spinnler, Glastonbury, Conn.

[73] Assignee: Teleco Inc., Middletown, Conn.

[22] Filed: May 10, 1974

[21] Appl. No.: 468,643

[52] U.S. Cl. ..... 340/18 LD; 340/18 NC

[51] Int. Cl. ..... G01v 1/40

[58] Field of Search ..... 340/18 LD, 18 NC

[56] References Cited

UNITED STATES PATENTS 3,065,416 11/1962 Jeter ..... 340/18 LD 3,764,970 10/1973 Manning ..... 340/18 NC

*Primary Examiner*—Maynard R. Wilbur

*Assistant Examiner*—S. C. Buczinski

[57] ABSTRACT

A mud pulse telemetry system is presented for transmitting information from the bottom of a well hole to the surface. The mud pulse telemeter is a pilot operated valve which restricts the flow of mud in the drill string to set up pressure waves in the mud stream which can be detected at the surface. The pilot operated mud pulse telemeter uses a small input signal to operate the telemeter valve by pressure differentials created in the mud stream itself.

5 Claims, 2 Drawing Figures

PILOT OPERATED MUD-PULSE VALVE

BACKGROUND OF THE INVENTION

This invention relates to the field of telemetry systems for transmitting information from the bottom of a well hole to the surface. More particularly, this invention relates to the field of mud pulse telemetry where information detected down the well is transmitted to the surface by pressure pulses created in a circulating mud stream in the drill string.

The desirability and effectiveness of well logging systems where information is sensed in a well hole and transmitted to the surface through mud pulse telemetry has long been recognized. Systems of this type, i.e. mud pulse telemetry systems, provide the driller at the surface with a means for quickly determining various kinds of information down the well, most particularly information about the location and direction of the drill string at the bottom of the well.

Because of the tremendous investment already made in drill pipe and drill collars, it is highly desirable that a bore hole telemetry system be compatible with existing drilling equipment and require minimum or no modification to the drill pipe and drill collars. Mud pulse telemetry is well known to offer an effective solution since it does not rely upon conductor wires to the surface or other mechanisms which may necessitate modification to existing hardware and provides a very fast communication link to the surface since the pulses travel at the speed of sound through the mud. In mud pulse telemetry systems, the telemeter is usually in the form of a valve which intermittently restricts the flow of mud within the drill string, and the valve is usually located in the vicinity of the drill bit. The telemeter may be lowered on a wire line located within the drill collar, but it is more usually formed as an integral part of a special drill collar inserted into the drill string near the drill bit. Representative disclosures of the prior art in mud pulse telemetry systems may be found in U.S. Pat. Nos. 2,677,790, 2,901,685, 2,973,505, 2,964,116, 3,309,656, 3,065,416, 3,693,428, 3,737,843, 3,764,970, 3,764,969, 3,764,968, and 3,770,006, the reference herein to such prior art patents being merely for purposes of illustration and not a complete listing of all prior art in this field.

A continuous column of mud is circulated within the drill string from the surface of the well to the drill bit at the bottom of the well during normal drilling operation. The basic operational concept of mud pulse telemetry is to intermittently restrict the flow of mud as it passes through a down hole telemeter valve to thereby create pressure pulses in the mud stream which travel to the surface at the speed of sound through the drilling mud. The information sensed down the well and which is to be transmitted to the surface is used to intermittently actuate the valve which restricts the mud flow, thereby transmitting pulses or digital information, and the pulses are detected at the surface and transformed into electrical or other signals which can be decoded and processed to reveal the transmitted information.

In typical oil and gas well drilling, mud is circulated through the interior of the drill pipe at flow rates ranging from 300 to 1000 gallons per minute. The mud pulse telemeter must operate to partially restrict this flow, and therefore must control a larger amount of energy. The telemeter valve must actuate quickly to create a pressure pulse, and the intermittent flow restriction must be sufficient to create a pressure rise which will, after attenuation from travelling through the mud to the top of the well, be detectable at the surface. At these typically high flow rates of the mud, considerable force and work are required to actuate the telemeter valve in the manner necessary to create the desired pressure pulses.

A downhole telemeter which is capable of forcefully driving the telemeter valve up into the mud stream must contain a power source sufficiently large to perform the required work. A typical power source discussed in a literature consists of a turbine driven by the mud flow to power an electric generator or other device to actuate the pulse valve. This approach, i.e. of the mud turbine, requires a large energy source, and presents design complications from the need to package the entire telemeter system within the rather narrow diameter of the drill string so that it may be compatible with existing drilling equipment. A telemetry system which is capable of performing the desired functions with a smaller amount of control energy is extremely desirable. Such a system can lend itself to size reduction or even miniaturization and can be easily packaged within the confines of existing drill pipes and drill collars. Furthermore, if input power requirements can be made low enough, power sources other than mud driven turbines, such as high temperature batteries, can be used.

SUMMARY OF THE INVENTION

The present invention includes a mud pulse telemeter in which the pulsing valve is operated by a pilot valve mechanism which is, in turn, controlled by a small amount of input power. The pilot valve controls mud pressure differentials across the primary (pulsing) valve whereby pressure differentials in the mud column itself provide the large actuating force necessary to effectively operate the telemeter system. Actuation of the pilot valve causes the primary mud pulse valve to actuate and thereby create the desired pressure pulses in the mud stream for travel to the surface.

The size of the entire telemeter system in the present invention is fully compatible with typical drill string and drill collar sizes so that the telemeter system can be entirely contained within the drill string. Furthermore, while the telemeter system of the present invention is fully compatible with telemeter systems incorporating mud pulse turbines, the power input requirements for the pilot valve are low enough so that a battery operated system (instead of one having a turbine and generator) is also feasible.

BRIEF DESCRIPTION OF THE DRAWING

Referring now to the drawings, wherein like elements are numbered alike in the several figures.

DESCRIPTION OF THE PREFERRED EMBODIMENT

In the interests of conciseness and clarity, the following description will be limited to that part of the apparatus which is located down the well and employed in the actual creation of the mud pulses for transmission to the surface. As will be understood by those skilled in the art, companion apparatus, of types well known in the art, will be employed at the surface of the well to receive the mud pulse signals. Similarly, various sensors, which may be of the type known in the art such as discussed in U.S. Pat. No. 3,657,637 will be employed to sense the information which is to be transmitted via the mud pulses.

Figure 1:
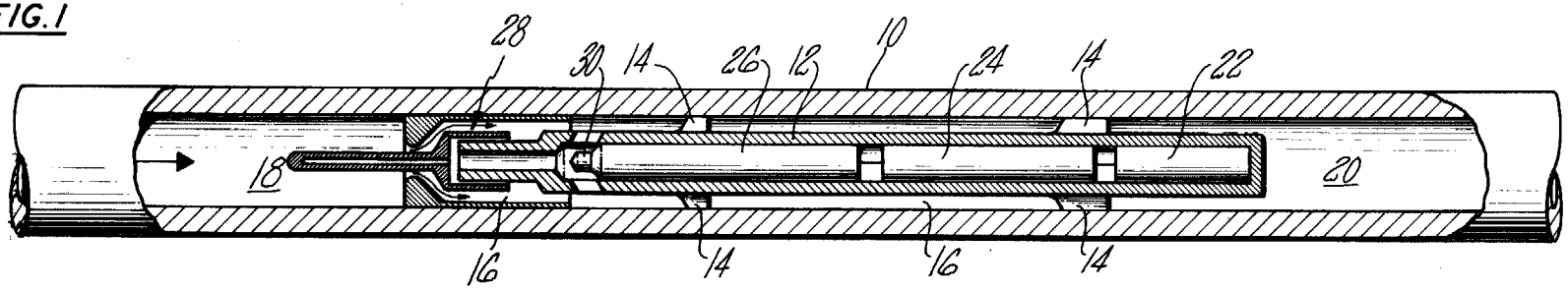
FIG. 1 is a schematic sectional view of the telemeter of the present invention.

Referring now to FIG. 1, a drill collar or drill string segment 10 is located down the well in the vicinity of the drill bit. Drill collar semgnet 10 is a special segment in the drill string containing the telemeter. Contained within drill collar 10 is a cylindrical casing or housing 12 positioned by spiders 14 centrally of collar 10 to provide an annular passage 16 from the section 18 of the telemeter casing to the section 20 downstream of the telemeter casing. As viewed in FIG. 1, the top or upstream portion of the drill string is to the left, and the bottom or downstream section is to the right.

Telemeter casing 12 houses a power supply 22, a sensor package 24 which is connected to and receives power from power supply 22, and a pilot valve actuator 26 which receives actuating signals from sensor package 24. Power supply 22 is preferably a bank of batteries; but it may also be a mud powered turbine and generator unit as is known in the art or any other power supply known in this art. The sensors wihthin the sensor package 24 may be any known sensors for sensing various parameters down the well. In particular, there may be sensors for detecting parameters commensurate with the inclination and direction of the drill string at the bottom of the well; and in this regard they may be, for example, the type of sensors shown in U.S. Pat. No. 3,657,637. Such sensors typically generate electrical signals which are used for positioning the mud pulse valve, and such electrical signals are contemplated for use in this invention. The pilot valve actuator 26 may be any suitable device for receiving electrical signals and generating a linear output of a pilot valve unit. For example, it may be a solenoid operated unit which receives electrical input signals and produces a linear output of the pilot valve attached to the solenoid.

During regular operation of the drill string i.e. when telemetry is not occurring, the drilling mud is forced to flow under pressure from the top of the well to upstream casing segment 18 and thence, in the direction indicated by the arrows, to annular passage 16 and thence to downstream segment 20 to be delivered to the drill bit. The mud is also delivered to the interior of a telemetry valve 28, which valve is maintained in the open position shown in FIG. 1 during normal drilling operation.

When it is desired to transmit information to the surface by mud pulse telemetry, a pilot valve 30 is actuated by pilot valve actuator 26 whereby telemetry valve 28 is cycled to close and open, the closing of valve 28 restricting mud flow and thus acting to generate pressure pulses in the mud stream.

Figure 2:
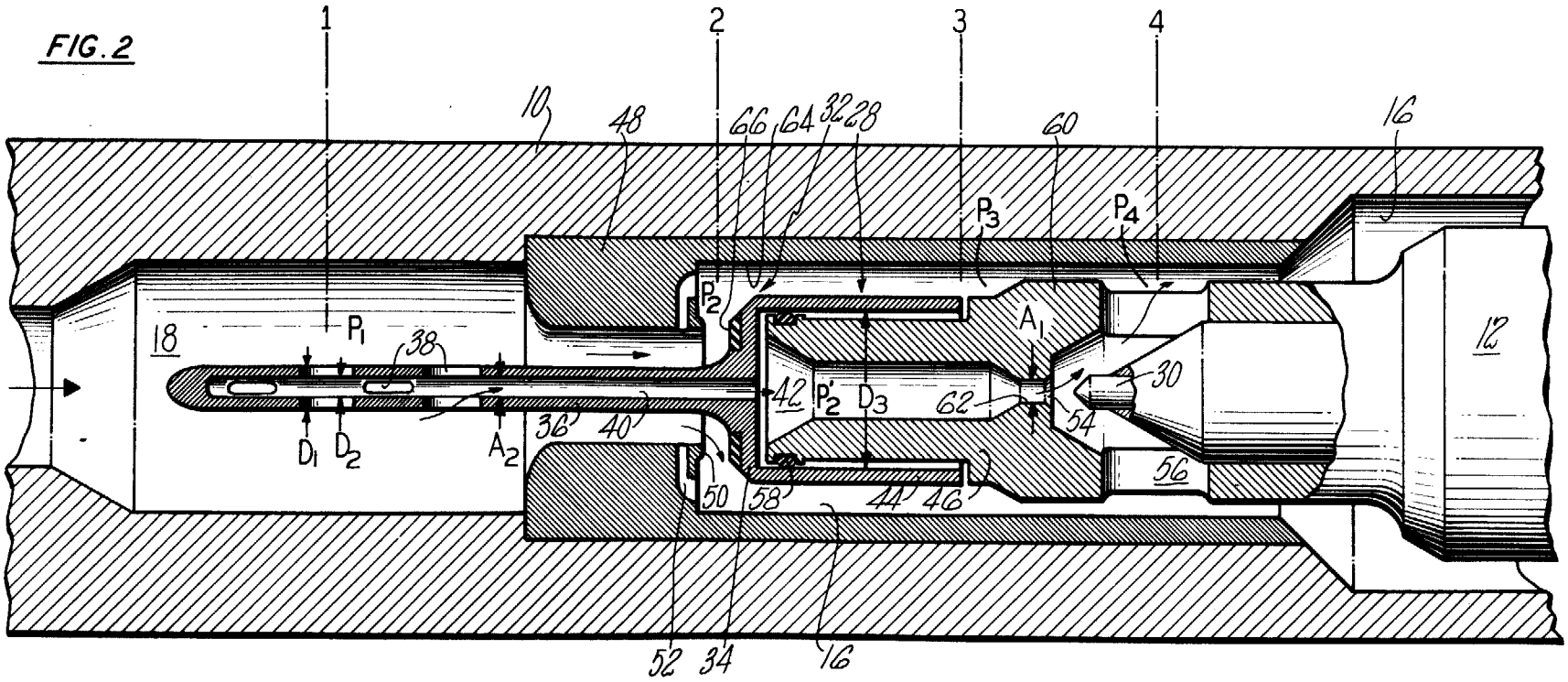
FIG. 2 is an enlarged detail of the main pulse valve and pilot valve of FIG. 1.

Referring now to FIG. 2, details of the telemetry valve 28 with its included pilot valve 30 are shown. Telemetry valve 28 has an annular primary valve piston-type element 32 which is translatable along the axis of the drill string. Primary valve 32 has a piston segment 34 with a probe 36 extending upstream therefrom. Probe 36 has a plurality of inlet passages 38 along its length leading to an interior passage 40 which communicates with the hollow interior 42 of primary valve 32 on the right side (downstreamside) of piston 34. The hollow interior 42 is defined by an annular skirt 44 on valve 32 extending from piston 34 in cooperation with a stationary valve housing 46 which extends into the interior of skirt 44 and provides a guide surface on which primary valve 32 rides. A restrictor element 48 is on the left side of piston 34. Restrictor 48 has an annular valve seat 50 against which the left side of piston 34 may bear to restrict (which may include substantial termination of) mud flow between the valve seat and the piston when telemetry pulses are being generated. Since it is undesirable to completely terminate all mud flow, bypass passages or flutes 52 are located in restrictor 48 to permit a continued flow of mud to annular passage 16 even if valve 32 is seated against valve seat 50. It should also be noted that the presence of bypass passages or flutes 52 provides a fail-safe feature in the event the pilot valve mechanism should fail in the closed position. If such failure were to occur, the flow of drilling mud to passage 16 is not fully blocked off, and thus mud flow and drilling can continue, although at a somewhat higher pump pressure, until it is convenient to remove the drill string to cure the pilot valve failure.

Telemetry valve 28 is shown in FIG. 2 in the inactive position where normal drilling is taking place and no telemetry is occurring. In this situation, drilling mud flow is as shown by the flow arrows, with mud flowing from upstream collar segment 18 through valve 28 to annular passage 16. A portion of the mud also flows through inlets 38 to passageway 40 of probe 36 and into hollow interior 42. The mud flowing into hollow interior 42 flows past a pilot valve seat 54 and through a series of passages 56 in housing 46 to rejoin the main mud flow in annular passage 16. An O-ring type seal 58 prevents leakage of the mud between housing 46 and skirt 44.

In the present invention the force requred to quickly drive primary valve 30 toward its closed position is primarily derived from the mud stream itself. This actuating force is accomplished by the combined interaction effects of the pilot valve and the mud flow pattern from certain design features of valve 28 which produce desired pressure differentials between stations in the system. These pressure differentials play an important part in the operation of this invention, and for purposes of discussion various positions or stations have been labeled 1, 2, 3 and 4 along the valve in the direction of flow through the valve.

Whenever mud flows through the drill, in the non-telemetry condition of FIG. 2, the pressue $P_1$ at station 1 is greater than the pressure $P_2$ at station 2 downstream of the flow orifice between the valve seat and piston 34. Valve housing 46 has a downstream section 60 of increased diameter to reduce the size of flow passage 16 and induce a pressure drop between stations 3 and 4. Accordingly, the pressure $P_3$ at station 3 just upstream of section 60 is essentially equal to the pressure $P_2$ at station 2 while the pressure $P_4$ at station 4 downstream of section 60 is lower than $P_3$. With the valve in the position shown in FIG. 2, valve interior 42 is in flow communication with passage 16 downstream of section 60 through passages 56 and the flow orifice between pilot valve 30 and seat 54. The pressure $P_4$ is lower than the pressure $P_2'$ in hollow interior 42, and $P_2'$ on the right side of piston 34 is less than $P_2$ on the left side of piston 34. It will be noted that the increased housing diameter 60 between stations 3 and 4 provides or induces the pressure differential between $P_2$ and $P_2'$, and this pressure differential is sufficient to insure positive opening action of valve 32 to the position shown in FIG. 2 when pilot valve 56 is in the open position as shown in FIG. 2.

By way of analysis, with the pilot valve open, an approximation of the forces acting on valve 32 are as follows, with the diameters $D_1$ through $D_3$ being as indicated in the drawing:

$$(1): \quad (P_1 - P_2') \frac{\pi}{4}(D_1^2 - D_2^2)$$

plus $$(2): \quad (P_2 - P_2') \frac{\pi}{4}(D_3^2 - D_1^2)$$

The net force resulting from these expressions is to the right since $P_1$ and $P_2$ are both greater than $P_2'$. Thus, with pilot valve 30 open, valve 32 will remain or be driven to its full open position.

The approximations for the above equations are based on the assumption that:

1. The pressure $P_2$ on the left face of piston 34 is an average or effective valve of the actual pressure gradient which will exist on that face; and

2. Skirt 44 is thin walled so that its area is much smaller than the area determined by $D_3$, so forces acting on the ends of skirt 44 can be ignored.

Pilot valve 30 is driven toward or to its fully closed position (where it is seated against seat 54) as a result of actuating signals from pilot valve actuator 26. When pilot valve 30 is seated against seat 54, the mud flow from hollow interior 42 through passages 54 is terminated, and the pressure at $P_2'$ then rises to equal $P_1$ since the mud in interior 42 is in direct communication with mud at $P_1$. Therefore, as pilot valve 30 closes, $P_2'$ becomes greater than $P_2$ thus effecting a net force to the left tending to drive primary valve 32 to the left toward its closed position against seat 50. As valve 32 moves to the left, the main mud flow stream from section 18 to annular passage 16 is increasingly restricted with a resultant increase or build-up in pressure $P_1$ (which is also the pressure pulse to be transmitted to the surface) and hence an increase in pressure $P_2'$. In other words, as the pressure $P_2'$ in chamber 42 increases to move valve 32 to the left, the continued leftward movement results in further increasing of the pressure $P_2'$ and hence more positive closing action of the valve 32, thus resulting in a quick positive closing of valve 32. With pilot valve 30 fully seated against its seat 54, the forces acting on primary valve 32 are as follows:

$$(1): \quad (P_1 - P_2') \frac{\pi}{4}(D_1^2 - D_2^2) = 0 \text{ since } P_1 = P_2'$$

and $$(2): \quad (P_2 - P_2') \frac{\pi}{4}(D_3^2 - D_1^2)$$

Thus, the net force is to the left since $P_2'$ is greater than $P_2$, and primary valve 32 is driven to its closed position when the pilot valve is closed. Once the pilot valve is opened, the pressure $P_2'$ decreases as mud flow resumes from interior chamber 42 past the pilot valve and through passages 56 to passage 16 at station 4, and then the net forces again acting on the valve are to the right to open primary valve 32.

As has been noted, the pilot valve mud flow is derived from hollow interior 42. It is important in the present invention to maintain a desired relationship between the flow area or flow volume in probe 36 and the flow area or flow volume exiting from chamber 42. The relationship to be maintained is that the cross-sectional flow area, and hence the flow volume, through probe 36 must be less than the cross-sectional flow area, and hence the discharge flow, from chamber 42. As shown in FIG. 2, this control is maintained by establishing a discharge passage 62 from chamber 42 through the flow orifice fo the pilot valve, the cross-sectional area $A_1$ of discharge passage 62 being larger than the cross-sectional area $A_2$ of probe 36.

The flow pattern in the area between restrictor 48 and valve 32 is characterized by high flow rates and rapid change of flow direction. Turbulence and eddying is therefore apt to occur in this area with attendant possiblities for erosion, especially if the mud contains large amounts of recirculative drilling solids. In order to protect against possible erosion damage, flow passages 52, seat 50 and wall 64 downstream of the valve opening may be made of or coated with tungsten carbide or other abrasion resistant material. Similarly, the upstream face of piston 34 may be provided with an elastomeric insert 66 to prevent erosion of that part of the piston face which serves to deflect the mud stream.

From the foregoing it can be seen that whenever the pilot valve is actuated in response to the sensing of conditions down the well, the primary valve 32 is actuated in response to movement of the pilot valve to generate mud pulses (i.e. the increased $P_1$ pressures) to be delivered to the surface. The mud pulses are generated by the sequential closing and opening of primary valve 32 since the closing of the primary valve results in a pressure build-up or surge in the main mud stream.

While a preferred embodiment has been shown and described, various modifications and substitutions may be made thereto without departing from the spirit and scope of the invention. Accordingly, it is to be understood that the present invention has been described by way of illustration rather than limitation.

What is claimed is:

1. Telemetry apparatus for transmitting data to the surface during the drilling of a borehole by generating pressure pulses in a drilling fluid in a drill string, the apparatus comprising pilot operated valve means which includes:

primary valve means adapted for mounting in a drill string segment in which the drilling fluid flows, said primary valve means being movable between a first position corresponding to maximum flow of the drilling fluid and a second position restricting the flow of the drilling fluid;

an interior chamber in said primary valve;

said primary valve defining a piston, one side of said piston forming one wall of said interior chamber;

valve seat means for said primary valve means, said valve seat means and a face of said primary valve means cooperating to define a first variable flow orifice therebetween for flow of the drilling fluid from a drill string part upstream thereof to a drill string part downstream thereof;

delivery passage means from said first flow orifice for delivering drilling fluid downstream of the pilot operated valve means;

restriction means in said delivery passage means to establish a pressure drop in drilling fluid flowing past said restriction means;

probe means extending from said primary valve means in the direction to project into the part of the drill string upstream of said first variable flow orifice;

passage means in said probe means, said passage means being connected to said interior chamber and having inlet means for connecting to the upstream part of the drill string, whereby said interior chamber is in flow communication with the upstream part of the drill string;

discharge passage means from said interior chamber for connecting said interior chamber to said delivery passage means downstream of said restriction means, the flow area of said discharge passage means being greater than the flow area of said passage means in the probe means; and second variable flow orifice means for varying the flow from said interior chamber to said delivery passage means downstream of said restriction means, said second variable flow orifice having pilot valve means variable between a first position corresponding to said first position of said position of said primary valve means and a second position corresponding to said second position on said primary valve means.

2. Telemetry apparatus as in claim 1 wherein:

said primary valve means is operated by pressure differentials in the drilling fluid to generate the pressure pulses in the drilling fluid.

3. Telemetry apparatus as in claim 2 wherein:

said interior chamber of said primary valve is in maximum flow communication with said delivery passage means when said pilot valve means is in said first position, and said interior chamber is substantially cut off from said delivery passage means in said second position of said pilot valve means, whereby the pressure differentials in the drilling fluid load said primary valve means to said first position thereof when said pilot valve is in its first position, and the pressure differentials in the drilling fluid load said primary valve to said second position thereof when the pilot valve is in its second position.

4. Telemetry apparatus as in claim 1 including:

bypass flutes in said valve seat to insure a minimum flow of drilling fluid to said delivery passage means.

5. Telemetry apparatus as in claim 1 wherein:

the pressure of drilling fluid on said one side of said piston is greater than the pressure of the drilling fluid in said interior chamber in said first position of said pilot valve means, and the pressure of the drilling fluid in said interior chamber is greater than the pressure on said one side of said piston in said second position of said pilot valve means.

* * * * *